US006991038B2

(12) United States Patent
Guesnon et al.

(10) Patent No.: US 6,991,038 B2
(45) Date of Patent: Jan. 31, 2006

(54) METHOD FOR DIMENSIONING A RISER ELEMENT WITH INTEGRATED AUXILIARY LINES

(75) Inventors: Jean Guesnon, Chatou (FR); Christian Gaillard, Rueil Malmaison (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 242 days.

(21) Appl. No.: 10/419,857

(22) Filed: Apr. 22, 2003

(65) Prior Publication Data

US 2003/0205380 A1 Nov. 6, 2003

(30) Foreign Application Priority Data

May 3, 2002 (FR) ..... 02 05544

(51) Int. Cl.
*E21B 29/12* (2006.01)

(52) U.S. Cl. ..... 166/345; 166/367; 405/224.2

(58) Field of Classification Search ..... 166/345, 166/359, 362; 405/224.2
See application file for complete search history.

(56) References Cited

U.S. PATENT DOCUMENTS 4,040,264 A 8/1977 Neilon
4,423,983 A 1/1984 Dadiras et al.
2003/0026663 A1 * 2/2003 Guesnon et al. ..... 405/224.2

FOREIGN PATENT DOCUMENTS

FR 2799769 4/2001

OTHER PUBLICATIONS

Hyperstatic Riser System Lessens Buoyancy, Wall Thickness Needs, Stress Distributed Between Main, Peripheral Tubes, Gaillard et al. May 2001 vol. 61, No. 5 pp 140.

* cited by examiner

*Primary Examiner*—William Neuder
(74) *Attorney, Agent, or Firm*—Antonelli, Terry, Stout and Kraus, LLP.

(57) ABSTRACT

The method relates to a riser comprising a main tube and auxiliary lines. Each tubular element forming the auxiliary lines is fastened at one end by a complete link with the central tube and at the other end by a link allowing a longitudinal play J with the central tube.

The method provides adjustment of play J so that, on the one hand, during conventional drilling operations, the elements forming the auxiliary lines slide in relation to the central tube and, on the other hand, during show control or testing operations, the elements forming the auxiliary lines form hyperstatic assemblies with the central tube.

The method thus allows to prevent buckling of the peripheral lines when they are under pressure because they work under hyperstatic conditions.

9 Claims, 1 Drawing Sheet

METHOD FOR DIMENSIONING A RISER ELEMENT WITH INTEGRATED AUXILIARY LINES

FIELD OF THE INVENTION

The present invention relates to risers comprising a main tube provided with peripheral lines. It provides a method of determining the longitudinal play between the peripheral line and the main tube so that the peripheral line is in a hyperstatic situation in a predetermined operating mode, in particular when it is subjected to high internal pressures.

A riser consists of an assembly of tubular elements whose length ranges between 15 and 25 m (50 and 80 feet) assembled by connectors. The tubular elements constitute, on the one hand, the main tube which contains the drillpipe and in which the drilling mud circulates, and on the other hand the auxiliary lines known as kill line and choke line, arranged parallel to the main tube, which allow circulation of a fluid between the blowout preventers at the riser bottom and the top of the central riser without flowing through the main tube.

BACKGROUND OF THE INVENTION

In the prior art, auxiliary lines consist of assemblies of tubes entirely made of steel. The dimensions of the tubes are determined in such a way that the tubes withstand the bursting stresses due to the internal/external pressure difference, the collapsible loads due to the internal pressure applied at the ends of the tubes and the tensile stresses exerted during hydraulic tests. Documents FR-01/10,360 and FR-01/10,361 are aimed to make auxiliary lines with hooped tubes. Using hooped tubes notably affords the advantage of reducing the steel thickness and therefore the weight of the tubes that constitute the auxiliary lines. However, the drawback of hooped tubes is that they have a lower flexural stiffness than the equivalent all-steel tubes for the same working pressure. Now, the tubes are subjected to collapsible loads generated by the internal/external pressure difference which causes what is referred to as a << bottom effect >> exerted on the ends of the tubes. Consequently, for the same bursting strength, a hooped tube has a smaller buckling length than the equivalent all-steel tube. The buckling length is the length of a tube from which it is likely to buckle when it is subjected to given collapsible loads. Considering the pressures to which the auxiliary lines may be subjected (1034 bars, i.e. 15,000 psi in working pressure), the hooped tubes that constitute the auxiliary lines on a riser are likely to buckle. To avoid this problem, it is possible to link the hooped tube elements to the main tube by means of clamps. The clamps hold the hooped tube elements in relation to the main tube, but they allow the hooped tube elements to freely slide in relation to the main tube in the direction of the riser axis. However, the use of clamps can be incompatible with the use of floats on the riser. It is usual to arrange floats over the length of the riser to reduce the tension at the riser top. The floats must have a minimum length to minimize manufacturing costs. This minimum length requires a length between two clamps that is sometimes incompatible with the minimum buckling length at the working pressure.

SUMMARY OF THE INVENTION

The object of the present invention is notably to prevent buckling of the tubes that constitute the auxiliary lines while respecting the architecture of the riser.

The present invention is aimed to link the tubes that constitute the auxiliary lines to the central tube in such a way that:

- the tubes that constitute the auxiliary lines can deform independently of the main tube as long as the value of the internal/external pressure difference applied to the auxiliary lines is below a predetermined value, and
- each hooped tube forms a hyperstatic assembly with the central tube at least when the internal/external pressure difference applied to the auxiliary lines exceeds said predetermined value.

In general terms, the present invention relates to a method for dimensioning a part of a riser comprising a main tube, a tubular element that constitutes an auxiliary line portion, the tubular element being linked to the main tube by a fit-in link located at a first end of the tubular element and by a sliding pivot link located at a second end of the tubular element, allowing a longitudinal play in relation to the main tube, the play having a value J when the tubular element and the main tube undergo no stresses; the method comprises the following stages:

(a) determining value Pm representing the maximum difference between the internal pressure and the external pressure that can be withstood by the tubular element without buckling, considering the free length between said links, (b) determining value J for the tubular element to form a hyperstatic assembly when the difference between the internal pressure and the external pressure applied to the tubular element is higher than value Pm determined in stage (a).

Furthermore, in stage (b) of the method according to the invention, it is possible:

(c) according to the depth of immersion, to determine the stresses undergone by the tubular element and by the main tube when the tubular element undergoes a difference between the internal pressure and the external pressure of value Pm, (d) by taking account of the stresses determined in stage (c), to determine the relative elongation Alg according to the depth of immersion, relative elongation Alg being the difference between the shortening of a tubular element and the elongation of the main tube between said links located at the ends of the tubular element, (e) fixing the value of play J less than or equal to the minimum relative elongation Alg determined in stage (d).

The method according to the invention can comprise the following stage:

(f) dimensioning the fit-in link and the link allowing a play of value J by taking account of the stresses undergone by the tubular element having the maximum relative elongation Alg determined in stage (d).

According to the invention, the tubular element can be linked to the main tube by at least one intermediate sliding pivot link located between said first and second ends and, in stage (a), it is possible to determine value Pm considering the free length between said intermediate sliding pivot link and one of said links located at the ends of the tubular element.

According to the invention, the tubular element can be linked to the main tube by at least two intermediate sliding pivot links located between said first and second ends and, in stage (a), value Pm is determined considering the free length between said two intermediate pivot links.

In stage (b), it is possible to determine value J when the tubular element undergoes a difference between the internal and external pressure Pm reduced by a security value.

The sliding pivot link allowing a longitudinal play in relation to the main tube can comprise a plate pierced with an orifice and fastened to the main tube, a sleeve fastened to the tubular element forming a stop on the plate, the tubular element sliding in the orifice.

According to the invention, the tubular elements are steel tubes hooped by means of reinforcing wires. The reinforcing wires can be made of glass fibers, carbon fibers or aramid fibers coated in a polymer matrix.

BRIEF DESCRIPTION OF THE DRAWINGS

Other features and advantages of the invention will be clear from reading the description hereafter, with reference to the accompanying drawings wherein.

DETAILED DESCRIPTION

Figure 1:
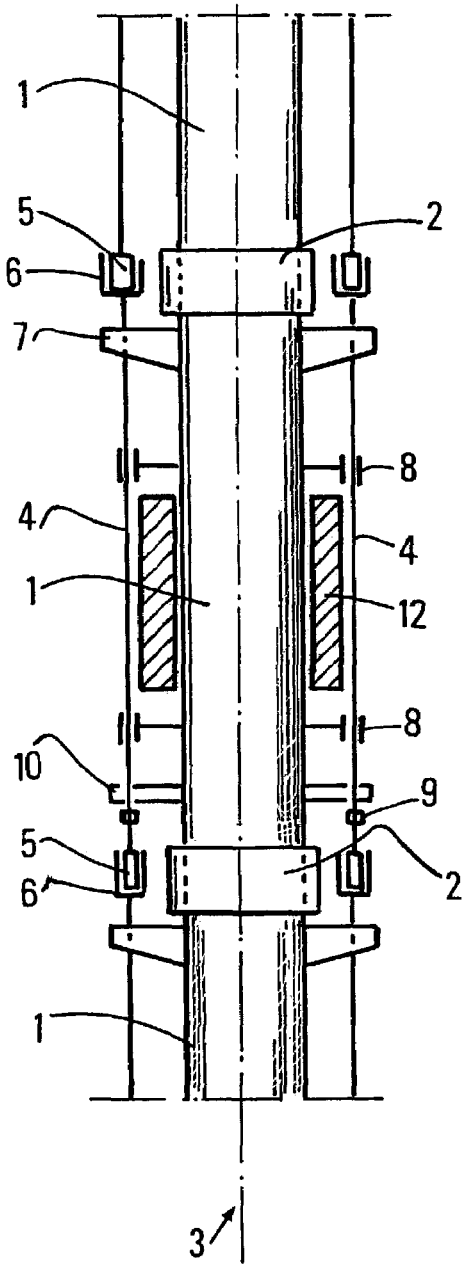
FIG. 1 diagrammatically shows a riser according to the invention.

FIG. 1 diagrammatically shows a part of a riser. Reference number 1 designates an element of the main tube of the riser. Elements 1 are tubular and assembled together by mechanical connectors 2 which can be those described in document EP-0,147,321. The assembly of elements 1 forms the main tube of axis 3. Two auxiliary lines are shown in FIG. 1. The auxiliary lines conventionally referred to as kill line and choke line are used to ensure the safety of the well during show control procedures in the well. The auxiliary lines are arranged parallel to axis 3. The auxiliary lines consist of the assembly of elements 4 whose length is substantially equal to the length of elements 1. Thus, two elements 4 arranged at the same height on the riser correspond to each element 1. Elements 4 are also tubular. Each element 4 comprises at its ends male and female terminal pieces bearing reference numbers 5 and 6 respectively. The terminal pieces of an element 4 cooperate with the terminal pieces of the upper and lower elements so as to have sealed links. These links between terminal pieces 5 and 6 can accept an axial play, i.e. they accept to a certain extent the displacement of an element 4 in relation to the contiguous element 4. Fastening means 7 provide a fit-in link between the upper end of each element 4 (generally close to female terminal piece 6) and element 1. Fastening means 7 can consist of screwing, bolt fastening or welding. Thus, at the level of fastening means 7, each element 4 is secured to element 1. Clamps 8 are distributed, at regular or irregular intervals, over the length of elements 1 and 4. Clamps 8 allow to link element 4 to element 1 by means of a sliding pivot link. In the present description, a sliding pivot link refers to a link that links a first solid to a second solid, the first solid can translate in relation to the second solid in the direction of an axis and the first solid can pivot in relation to the second solid about this axis. At the level of a clamp 8, element 4 can slide in the direction of axis 3 and pivot about axis 3, but element 4 is not free to move in the radial and tangential directions, i.e. in the directions of a plane perpendicular to axis 3. Thus, clamps 8 allow to impose the radial position of an element 4 in relation to an element 1. Clamps 8 allow to reduce the free length of element 4 and consequently to increase the buckling strength of elements 4. Between two clamps 8, the riser can be provided with floats 12.

Figure 2:
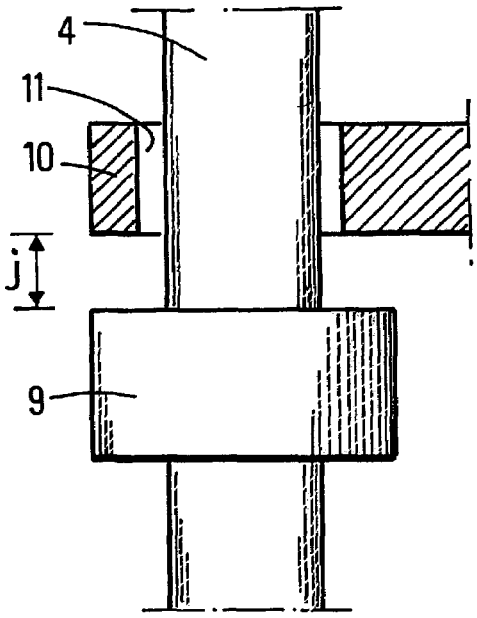
FIG. 2 shows a detail of the riser according to the invention.

FIG. 2 illustrates the principle of the link between the lower end of an element 4 and element 1. A longitudinal play is allowed between the lower end of element 4 and element 1 by means of a sliding pivot link. In the lower part, element 1 comprises a means 10 for fastening elements 4. Fastening means 10 can be a plate or a flange pierced with an orifice 11 whose diameter substantially corresponds to the outside diameter of an element 4. The lower end of an element 4 (generally close to male terminal piece 5) is provided with a stop 9. Stop 9 can be a sleeve fastened to element 4. Element 4 can slide in orifice 11. The position of stop 9 in relation to plate 10 is such that there is a play J between the lower face of plate 10 and the upper face of stop 9 when elements 1 and 4 undergo no mechanical stresses.

The value of play J can vary according to the elongation of elements 1 that constitute the central tube and to the shortening of elements 4 that constitute the auxiliary lines. Elements 1 are likely to lengthen because they have to take up, totally or partly, on the one hand, the weight of the riser and the weight of the drilling mud and, on the other hand, the tensile stresses applied to the riser so as to keep it substantially vertical. In general, elements 1 at the top of the riser, i.e. close to the surface of the sea, undergo the maximum tensile stresses, and therefore the maximum elongation. Elements 4 are likely to shorten under the effect of the difference between the internal pressure and the external pressure due to the fluid they contain. In fact, the fluid applies a pressure onto the ends of elements 4 by applying compressive stresses to elements 4. Furthermore, the radial deformation of the tube due to the difference between the internal pressure and the external pressure leads to a shortening of the tube. In general, elements 4 at the bottom of the riser, i.e. close to the sea bottom, undergo the maximum internal/external pressure difference, and therefore the maximum shortening.

As long as play J is positive, element 4 and element 1 located at the same height can vary in length independently of one another. On the other hand, when play J is zero, i.e. when stop 9 is in contact with plate 10, element 4 and the corresponding element 1 form a hyperstatic assembly: element 4 is secured to element 1 on the one hand at the level of fastening means 7 and, on the other hand, at the level of stop 9 which is in contact with plate 10. Consequently, element 1 induces tensile stresses in element 4 and, conversely, element 4 induces compressive stresses in element 1.

The invention aims to determine the value of play J according to the method described hereafter. Play J is determined in such a way that, on the one hand, element 4 can slide in relation to element 1 as long as the internal/external pressure difference (for example during conventional drilling operations) is not likely to cause buckling of element 4 and that, on the other hand, element 4 forms a hyperstatic assembly with element 1 when the internal/external pressure difference (for example during show control or testing operations) is likely to cause buckling of element 4.

The method according to the invention comprises stages 1 to 3 as follows:

Stage 1

Value Pm which represents the maximum difference between the internal pressure and the external pressure that can be withstood by an element 4 without buckling is determined. Value Pm is determined using the materials strength theory. The Eulerian formulation or any other method known to the man skilled in the art can be used for example.

The Eulerian formulation:

$$Lg = \sqrt{\mu \frac{\pi^2 EI}{P_i S_{et}}}$$

expresses the relation between the characteristics of a tube (E, I, $S_{et}$, Lg and $\mu$) and the maximum value $P_i$ of the difference between the internal and external pressure applied to this tube without its buckling.

More precisely:

length Lg is the free length between two links, i.e. the distance between two successive links connecting element 4 and element 1. Length Lg can be measured between two successive clamps 8 arranged on an element 4. Length Lg can also be measured between fastening means 7 and the contiguous clamp 8 or between plate 10 and the contiguous clamp 8;

coefficient $\mu$ depends on the nature of the links that connect element 1 to element 4 ($\mu$ can range between 1 for a tube length Lg between two knuckle links and 4 for a tube length Lg between two fit-in links);

parameter E refers to the elastic modulus of the material of element 4;

-Parameters $I$ and $S_{et}$ respectively designate the inertia of the section of the tube = $\frac{\pi}{64}(D_{ext}^4 - D_{int}^4)$ and the inner seal section of the terminal piece = $\frac{\pi}{4}D_{et}^2$.

value $P_i$ represents the difference between the internal pressure and the external pressure applied to element 4.

Within the context of the present invention, the Eulerian formulation is used to determine the value $P_i$ at which an element 4 buckles between two links, the characteristics of element 4 being known (E, I, $S_{et}$, Lg and $\mu$).

Considering the API 16Q standards edited by the American Petroleum Institute, an architecture of the riser and the characteristics of the various elements that constitute it are selected for predetermined conditions of use.

Length Lg and coefficient $\mu$ can be known from the riser architecture.

Parameters E, I and $S_{et}$ can be known from the characteristics of the auxiliary lines.

The maximum difference Pm between the internal and external pressure that can be withstood by an element 4 without buckling is thus determined.

Stage 2

According to the invention, value Pm is at least less than the value of the working pressure, otherwise the method is not suited to the riser architecture and to the characteristics of elements 4.

If value Pm is greater than the working pressure, one of parameters Lg, $\mu$, E, I and $S_{et}$ can be varied in order to decrease value Pm and to make it smaller than the working pressure. In general, length Lg is increased by increasing the distance between two clamps 8 or by removing a clamp 8.

In the present description, the working pressure is the maximum pressure value accepted by the auxiliary lines during operation, the test pressure being greater than the working pressure.

Stage 3

The value of play J is determined for element 4 to form a hyperstatic assembly with element 1 when the difference between the internal and external pressure applied to element 4 is greater than Pm. The following operations can be carried out:

according to the depth of immersion, determining at least the compressive stresses and the radial stresses undergone by an element 4 subjected to an internal/external pressure difference equal to Pm and deducing the shortening of this element 4, according to the depth of immersion, determining at least the tensile stresses undergone by an element 1 and deducing the elongation of this element 1, according to the depth of immersion, determining the relative elongation Alg (difference between the shortening of an element 4 and the elongation of element 1, elements 1 and 4 being located at the same depth), determining value Alg1 which designates the minimum value of the previously determined values Alg, giving play J the value Alg1 when element 4 and element 1 undergo no stress. For example, play J can be fixed when the riser is being initially mounted: when element 4 is assembled with element 1, no force is applied to elements 1 and 4.

When the value of play J is fixed by following stages 1, 2 and 3, elements 4 are not likely to buckle. When the internal pressure reaches value Pm in an auxiliary line, the relative elongation between an element 4 and element 1 is at least Alg1, and causes a zero play J for all the elements 4. Now, when play J is zero, element 4 is in a hyperstatic situation in relation to the corresponding element 1. Consequently, element 1 imposes tensile stresses on element 4, which consequently opposes buckling of element 4.

The value of play J, when elements 1 and 4 undergo no stress, can be the same for the whole of the riser. However, the riser can also consist of several parts, each part being differentiated for example by the thickness of the main tube, the quality of the floats, the number and the spacing between the floats, . . . Stages 1, 2 and 3 can be applied independently to each one of the different parts of the riser. Thus, a value of play J which can be different for each part of the riser is determined. For example, the riser consists of three parts of equal length. By applying stages 1, 2 and 3 to the part going from the sea surface to a depth equal to one third of the total length of the riser, a first play $J_1$ is determined. Similarly, a play $J_2$ and a play $J_3$ are determined for the other two parts of the riser.

After determining play J, fastening means 8, plate 10 and stop 9 can be dimensioned by means of stage 4 as follows:

The stresses undergone by fastening means 8, plate 10 and stop 9 when the auxiliary lines are under pressure are calculated. Calculation is carried out by considering elements 4 of the auxiliary lines in a hyperstatic situation in relation to elements 1 of the main tube. The dimensions of fastening means 8, of plate 10 and of stop 9 are determined considering element 4 whose relative elongation Alg determined in stage 3) is maximum. This dimensioning procedure can be carried out considering the following extreme conditions: maximum depth and maximum pressure in the auxiliary lines.

The method can be applied to any type of element 4, notably hooped tubes and all-steel tubes. A hooped tube can consist of a steel tube hooped by means of reinforcing glass, carbon or aramid fiber wires coated in a polymer matrix.

The method according to the invention is illustrated by the example as follows.

The architecture and the characteristics of the riser are as follows:

length of the riser: 2286 m length of an element 1 or 4: 22.86 m element 1 of the main tube: 533.4 mm×19.05 mm length of a connector 2: 0.9144 m outside diameter of the floats: 1.1811 m two auxiliary lines (kill line and choke line) made of hooped tubes (elements 4): 101.4 mm×11.0 mm–working pressure 1034 bars–seal diameter: 149.4 mm an auxiliary line (booster line) made of hooped tubes (elements 4): 152.4 mm×6.35 mm–working pressure 345 bars–seal diameter 177.8 mm two auxiliary lines (hydraulic line) made of an all-steel tube (elements 4): 47.6 mm×6.35 mm–working pressure 345 bars maximum mud density: 1.92 tension at the top of the riser: 587 tons (among which 100 tons at the bottom).

Calculation of the length between the clamps:

The buckling length Lg is calculated as follows (Eulerian formulation):

$$Lg = \sqrt{\mu \frac{\pi^2 EI}{P_i S_{et}}}$$

with:

$\mu$ the coefficient depending on the boundary conditions

E the elastic modulus of the tube material $$I \text{ the inertia of the tube section} := \frac{\pi}{64}(D_{ext}^4 - D_{int}^4)$$

$$S_{set} \text{ the inner seal section of the terminal piece} = \frac{\pi}{4} D_{et}^2$$

$P_i$ the difference between the internal and external pressure.

The buckling length is calculated by considering:

$\mu$=1 (conservative value, in reality $\mu$ is greater than 1), $P_i$: the maximum value considered is the hydraulic test value equal to 1.5 times the working pressure.

We obtain, by using the data specific to the architecture and to the characteristics of the riser (notably the characteristics of the kill line and of the choke line), a buckling length of 7.15 ft (2.18 m). Consequently, the distance between two successive clamps can be set to about 7 ft (2.18 m). Thus, whatever the conditions of use of the riser, the auxiliary lines will not buckle with a maximum distance of about 7 ft (2.18 m) between two clamps.

However, technical reasons require a reduction in the number of clamps. The technical reasons can be interference problems between clamps and floats, or a reduction in the number of clamps to reduce the costs. The length between clamps is fixed to 12 ft (3.74 m).

Considering a buckling length of 12 ft (3.74 m), we can deduce the maximum allowable pressure before buckling of an element 4 constituting the auxiliary lines by using for example the Eulerian formulation. The critical pressure is 550 bars. Thus, as long as the internal pressure in the auxiliary lines does not exceed 500 bars (considering 50 safety bars), elements 4 will not buckle. On the other hand, when the internal pressure exceeds 500 bars, elements that constitute the auxiliary lines are likely to buckle.

To prevent buckling, the invention proposes operating elements 4 in hyperstatic conditions by optimally adjusting play J between plate 10 and stop 9.

Adjusting the stop so that the lines do not buckle under any condition:

It is important to determine play J of the stop to ensure that no buckling occurs for all the conditions of use of the riser.

Determination of the maximum play of the auxiliary lines in relation to the main tube:

testing conditions of the auxiliary lines (500 bars) during the descent of the riser:

| | Elongation (mm) | |
|---|---|---|
| | At the top of the riser | At the bottom of the riser |
| Main tube | 14.2 | 10.8 |
| Kill line and choke line | −20.2 | −21.1 |
| Relative elongation | 34.2 | 31.9 |

well control conditions (at 500 bars):

| | Elongation (mm) | |
|---|---|---|
| | At the top of the riser | At the bottom of the riser |
| Main tube | 26.7 | 17.6 |
| Kill line and choke line | −13.1 | −21.0 |
| Relative elongation | 39.8 | 38.6 |

The minimum value of the relative elongation is 31.9 mm. Consequently, the maximum value of play J between plate 10 and stop 9 is 31.9 mm. In practice, play J is fixed at 31 mm when elements 1 and 4 undergo no stresses. Thus, when the pressure exceeds 500 bars in an auxiliary line, stop 9 comes into contact with plate 10 and elements 4 that constitute the auxiliary line work under hyperstatic conditions: element 1 applies tensile stresses to element 4. Elements 4 are therefore not likely to buckle.

Furthermore, one ensures that, for conventional drilling operations (i.e. with no pressure in the auxiliary lines), under extreme conditions (heavy mud, great depth), elements 4 do not work under hyperstatic conditions (i.e. the set play J is sufficient to allow elements 4 of the auxiliary lines to slide in relation to elements 1 of the main tube):

conventional drilling conditions, without pressure in the peripheral lines, the respective elongations are as follows:

| | Elongation (mm) | |
|---|---|---|
| | At the top of the riser | At the bottom of the riser |
| Main tube | 20.4 | 11.3 |
| Kill line and choke line | 0 | −8.0 |
| Relative elongation | 20.4 | 19.3 |

It can be observed that, under such conditions (conventional drilling), the relative elongation is less than play J, therefore elements 4 are perfectly sliding. Elements 4 are not in a hyperstatic situation whatever the mud density or the water depth.

Maximum stresses withstood by fastening means 7 or plate 10 under conventional drilling conditions

Elements 4 of the auxiliary lines being perfectly sliding, no stress is transmitted by fastening means 7 or plate 10.

lines testing conditions during the descent of the riser:

| | Play J (31 mm) | |
|---|---|---|
| | At the top of the riser | At the bottom of the riser |
| Stress in plate 10 (tons)/auxiliary line | 88 | 61 |

well control conditions:

| | Play J (31 mm) | |
|---|---|---|
| | At the top of the riser | At the bottom of the riser |
| Stress in plate 10 (tons)/auxiliary line | 128 | 84 |

If play J is reduced between plate 10 and stop 9, the stresses in plate 10 are significantly increased. The maximum stresses are obtained when the riser is operated under extreme conditions: maximum depth and pressure in the auxiliary lines. These stresses can be exerted at the top or at the bottom according to the riser architecture.

It is therefore important to determine play J precisely so that elements 4 can slide during conventional drilling stages (without pressure in the lines) and so that the assemblies consisting of an element 4 and the corresponding element 1 are hyperstatic in case of a risk of buckling of elements 4 of the auxiliary lines (during well control or testing).

What is claimed is:

1. A method for dimensioning a part of a riser comprising a main tube, a tubular element that constitutes an auxiliary line portion, the tubular element being linked to the main tube by a fit-in link located at a first end of the tubular element and by a sliding pivot link located at a second end of the tubular element, allowing a longitudinal play in relation to the main tube, the play having a value J when the tubular element and the main tube undergo no stresses, the method comprising the following stages:

(a) determining value Pm representing the maximum difference between the internal pressure and the external pressure that can be withstood by the tubular element without buckling, considering the free length between said links, (b) determining value J for the tubular element to form a hyperstatic assembly when the difference between the internal pressure and the external pressure applied to the tubular element is higher than value Pm determined in stage (a).

2. A method as claimed in claim 1, wherein the following stages are carried out in stage (b):

(C) according to the depth of immersion, determining the stresses undergone by the tubular element and by the main tube when the tubular element undergoes a difference between the internal pressure and the external pressure of value Pm, (d) by taking account of the stresses determined in stage (C), determining the relative elongation Alg according to the depth of immersion, relative elongation Alg being the difference between the shortening of a tubular element and the elongation of the main tube between said links located at the ends of the tubular element, (c) fixing the value of play J less than or equal to the minimum relative elongation Alg determined in stage (d).

3. A method as claimed in claim 2, wherein the following stage is carried out:

(f) dimensioning the fit-in link and the link allowing a play of value J by taking account of the stresses undergone by the tubular element having the maximum relative elongation Alg determined in stage (d).

4. A method as claimed in claim 1, wherein the tubular element is linked to the main tube by at least one intermediate sliding pivot link located between said first and second ends and wherein, in stage (a), value Pm is determined considering the free length between said intermediate sliding pivot link and one of said links located at the ends of the tubular element.

5. A method as claimed in claim 1, wherein the tubular element is linked to the main tube by at least two intermediate sliding pivot links located between said first and second ends and wherein, in stage (a), value Pm is determined considering the free length between said two intermediate pivot links.

6. A method as claimed in claim 1, wherein, in stage (b), value J is determined when the tubular element undergoes a difference between the internal and external pressure Pm reduced by a security value.

7. A method as claimed in claim 1, wherein the sliding pivot link allowing a longitudinal play in relation to the main tube comprises a plate pierced with an orifice and fastened to the main tube, a sleeve fastened to the tubular element forming a stop on the plate, the tubular element sliding in the orifice.

8. A method as claimed in claim 1, wherein the tubular elements are made of steel tubes hooped by means of reinforcing wires.

9. A method as claimed in claim 8, wherein the reinforcing wires are made of glass fibers, carbon fibers or aramid fibers coated in a polymer matrix.

* * * * *